US011766133B2

(12) United States Patent
Wakabayashi et al.

(10) Patent No.: US 11,766,133 B2
(45) Date of Patent: Sep. 26, 2023

(54) MATTRESS

(71) Applicants: FUNAI ELECTRIC CO., LTD., Osaka (JP); OSAKA UNIVERSITY, Osaka (JP)

(72) Inventors: Naoyuki Wakabayashi, Osaka (JP); Fuminori Tanaka, Osaka (JP); Jun Sugimoto, Osaka (JP); Masayuki Hirata, Osaka (JP); Yuka Omura, Osaka (JP); Kanae Kusakabe, Osaka (JP)

(73) Assignees: FUNAI ELECTRIC CO., LTD., Osaka (JP); OSAKA UNIVERSITY, Osaka (JP)

( * ) Notice: Subject to any disclaimer, the term of this patent is extended or adjusted under 35 U.S.C. 154(b) by 0 days.

(21) Appl. No.: 17/022,061

(22) Filed: Sep. 15, 2020

(65) Prior Publication Data

US 2021/0106143 A1 Apr. 15, 2021

(30) Foreign Application Priority Data

Oct. 11, 2019 (JP) ..... 2019-187812

(51) Int. Cl.

| | |
|---|---|
| ***A47C 20/04*** | (2006.01) |
| ***A61G 7/00*** | (2006.01) |
| ***A61G 7/07*** | (2006.01) |
| ***A61G 7/057*** | (2006.01) |

(52) U.S. Cl.

CPC ..... *A47C 20/048* (2013.01); *A61G 7/001* (2013.01); *A61G 7/05776* (2013.01); *A61G 7/07* (2013.01); *A61G 2203/34* (2013.01)

(58) Field of Classification Search

CPC .... A47C 27/001; A47C 20/048; A61G 7/001; A61G 7/05776; A61G 7/07

See application file for complete search history.

(56) References Cited

U.S. PATENT DOCUMENTS

| | | | | |
|---|---|---|---|---|
| 5,926,883 | A * | 7/1999 | Rechin | A61G 7/001 362/276 |
| 6,212,718 | B1 * | 4/2001 | Stolpmann | A61G 7/05776 285/914 |
| 7,246,389 | B2 | 7/2007 | Taguchi et al. | |
| 7,346,951 | B1 * | 3/2008 | Heaton | A61G 7/008 5/615 |
| 2009/0106898 | A1 * | 4/2009 | Flick | A61G 7/05776 5/424 |
| 2012/0317714 | A1 * | 12/2012 | Matschurek | A61G 7/001 5/81.1 RP |
| 2012/0317717 | A1 * | 12/2012 | Jin | E04H 15/02 5/110 |

(Continued)

FOREIGN PATENT DOCUMENTS

| | | |
|---|---|---|
| JP | 2003310668 | 11/2003 |

*Primary Examiner* — David R Hare
*Assistant Examiner* — Adam C Ortiz
(74) *Attorney, Agent, or Firm* — JCIPRNET

(57) ABSTRACT

A mattress 100 includes a movable part 1 and a mattress body 2 including a first mattress part 21 disposed above the movable part 1, and a second mattress part 22 provided separately from the first mattress part 21 and disposed to surround the first mattress part in a plan view. The first mattress part 21 is configured to rotate upward about the predetermined rotation axis by the movable part 1.

14 Claims, 10 Drawing Sheets

(56) References Cited

U.S. PATENT DOCUMENTS

| | | | | |
|---|---|---|---|---|
| 2014/0245539 | A1* | 9/2014 | Ooba | A61G 7/05784 5/636 |
| 2015/0296993 | A1* | 10/2015 | Boyd | A47C 27/15 5/665 |

* cited by examiner

MATTRESS

CROSS-REFERENCE TO RELATED APPLICATION

This application claims the priority benefit of Japan application serial no. 2019-187812, filed on Oct. 11, 2019. The entirety of the above-mentioned patent application is hereby incorporated by reference herein and made a part of this specification.

BACKGROUND

Technical Field

The disclosure relates to a mattress, and particularly to a mattress capable of changing a body posture of a person.

Description of Related Art

Conventionally, a mattress capable of changing a body posture of a person has been known (see, for example, Patent Document 1).

Patent Document 1 discloses a movable bed including a tilting mechanism for tilting a bed surface on which a mattress is placed sideways. In the bed of Patent Document 1, the tilting mechanism tilts the entire mattress to tilt the person and change the body posture.

RELATED ART DOCUMENT(S)

Patent Document(s)

[Patent Document 1] Japanese Patent Laid-Open No. 2003-310668

SUMMARY

However, with the mattress according to Patent Document 1, the person on the mattress is likely to slip down along the tilted mattress because the entire mattress is tilted to change the body posture of the person. Therefore, it is difficult to change the body posture.

The disclosure provides a mattress which prevents a person from slipping down in the case where the mattress is tilted and make it easy to change a body posture.

A mattress according to an aspect of the disclosure includes a movable part that includes a rotatably movable plate and an actuator for rotating the movable plate and a mattress body that includes a first mattress part disposed above the movable part, and a second mattress part provided separately from the first mattress part and disposed to surround the first mattress part in a plan view. The first mattress part is configured to be rotated upward about a predetermined rotation axis by the movable part.

In the mattress according to the first aspect of the disclosure, the first mattress part disposed to be surrounded by the second mattress part is configured to be rotated upward about the predetermined rotation axis by the movable part. Accordingly, in the case where the person is tilted by rotating only the first mattress part, since the person can be supported by the second mattress part that stays level and does not rotate, the person can be prevented from slipping down through the tilting of the first mattress part. As a result, since the person can be prevented from slipping down, the body posture can be changed easily. In addition, differing from the case where the entire mattress is rotated, since the upper/lower movement (vertical movement amount) of the mattress can be prevented from increasing, the lying person and the person nearby can be prevented from having a sense of insecurity.

In the mattress according to the first aspect, the mattress body may have a rectangular shape having a lateral direction and a longitudinal direction, and the second mattress part is disposed on both ends of the mattress body in the lateral direction to sandwich the first mattress part in the plan view. With such configuration, the second mattress part can be disposed on both ends of the mattress body in the lateral direction. Accordingly, since a portion of the person can be supported by the second mattress part that stays level and does not rotate even in the case where the first mattress part rotated in the direction of one of one end side or the other end side in the lateral direction of the mattress body, the body posture can be changed on the left or the right in the plan view.

In the mattress according to the first aspect, the second mattress part may be configured so as not to rotate. With such configuration, since the second mattress part stays level and does not rotate when the first mattress part is rotated, the space for supporting the body when the body posture is changed can be ensured.

In the mattress according to the first aspect, the movable plate may have a shape having a lateral direction and a longitudinal direction, and the movable plate has a rotation center axis tilted with respect to a center line that extends in the longitudinal direction and passes through a center of the movable plate in the lateral direction in the plan view. With such configuration, since the rotation center axis is tilted with respect to the center line that extends in the longitudinal direction in the plan view, the movable plate can be rotated obliquely with respect to the center line that extends in the longitudinal direction.

In the mattress according to the first aspect, the movable plate may include a first rotation center axis and a second rotation center axis, the first rotation center axis, in the plan view, is tilted in a direction with respect to a center line that extends in a longitudinal direction and passes through a center of the movable plate in a lateral direction, and the second rotation center axis, in the plan view, is tilted in another direction with respect to the center line that extends in the longitudinal direction and passes through the center of the movable plate in the lateral direction. With such configuration, since the first rotation center axis or the second rotation center axis, in a plan view, is tilted in one direction or another direction with respect to the center line that extends in the longitudinal direction of the movable plate, when the person lies on the first mattress part along the longitudinal direction of the movable plate, the person can be tilted sideways while being tilted forward through the rotation about the first rotation center axis or the second rotation center axis that is tilted in the plan view. Accordingly, since the shoulder position of the person can be higher than the waist position, the body posture can be changed easily in the case of rotating in the left or right direction.

In this case, the first rotation center axis may be tilted at a tilting angle of 10 degrees or more and 15 degrees or less in the direction with respect to the center line in the plan view, and the second rotation center axis may be tilted at a tilting angle of 10 degrees or more and 15 degrees or less in the another direction with respect to the center line in the plan view. In such configuration, with the tilting angle being 10 degrees or more and 15 degrees or less, the person can be suitably tilted forward while being tilted sideways.

In the configuration where the movable plate includes the first rotation center axis and the second rotation center axis, the movable plate may include a first plate member and a second plate member which is disposed below the first plate member and rotatably connected with the first plate member by the first rotation center axis. With such configuration, one of the first plate member and the second plate member can be fixed to the member on which the mattress body is placed, and the other can be fixed to the first mattress part. As a result, the first plate member can be rotated with the second plate member as a reference.

In this case, a third plate member which is disposed below the second plate member and rotatably connected with the second plate member by the second rotation center axis different from the first rotation center axis may be further provided. The first plate member, the second plate member, and the third plate member are disposed to overlap each other in the plan view. With such configuration, since the directions in which the first plate member and the second plate member are rotated can be different, for example, the body posture of the person can be changed between left and right. In addition, in the plan view, with the first plate member, the second plate member, and the third plate member being disposed to overlap each other, the space for disposing the movable plate in the plan view can be reduced.

In the mattress according to the first aspect of the disclosure, the first mattress part may be disposed on a center line that extends in a longitudinal direction of the mattress body and passes through a center of the mattress body in a lateral direction. With such configuration, since the first mattress part can be disposed on the center line of the person, the first mattress part can push up the person along the spine to change the body posture. As a result, for example, compared with the case of pushing up the side part, such as the flank, of the person, the body posture can be changed easily.

In the mattress according to the first aspect of the disclosure, the first mattress part may have a shape having a lateral direction and a longitudinal direction, and a length of the first mattress part in the longitudinal direction is a half or less of a length of the mattress body in a longitudinal direction of the mattress body, and the first mattress part is disposed on a side on which a head part of a person is placed in the longitudinal direction of the mattress body. With such configuration, for example, in the case of being used with a bed having a back raising function for raising the upper body of the person, the first mattress part can be prevented from being disposed over a position at which the first mattress part is bent by the back raising function.

In the mattress according to the first aspect of the disclosure, the first mattress part may have a maximum length in a lateral direction that is two thirds of a length of the mattress body in a lateral direction of the mattress body. With such configuration, since the length of the second mattress part in the lateral direction is one third or more of the length of the mattress body in the lateral direction, the length of the second mattress part can be sufficiently ensured. As a result, the space for changing the body posture can be ensured.

In the mattress according to the first aspect of the disclosure, the first mattress part may have a maximum length in a lateral direction that is 200 mm or more and 450 mm or less. Accordingly, with the maximum length in the lateral direction being 200 mm or more, the length of the first mattress part in the lateral direction can be sufficiently ensured, and the person can be rotated even in the case where an individual difference is present. In addition, with the maximum length in the lateral direction being 450 mm or less, since the length of the first mattress part in the lateral direction can be prevented from being greater than the shoulder width of the person, the person can be prevented from slipping down from the first mattress part.

In the mattress according to the first aspect of the disclosure, the actuator may include a first inflatable/contractible bag that is inflatable and contractible through supplying or exhausting of gas, and the movable plate is configured to adjust a rotation angle through supplying or exhausting of the gas to and from the first inflatable/contractible bag. With such configuration, since the rotation angle can be adjusted by supplying and exhausting the gas, the configuration of the mattress can be simplified.

In this case, a maximum tilting angle of the first mattress part may be 20 degrees or more and 60 degrees or less with respect to a horizontal plane. Accordingly, with the maximum tilting angle of the first mattress part being 60 degrees or less, the rotation angle can be prevented from being excessively large. In addition, with the maximum tilting angle of the first mattress part being 20 degrees or more, the person can be tilted sufficiently, so the operation can be easy in the case of changing the body posture.

The configuration in which the actuator includes the first inflatable/contractible bag may further include an angle sensor for measuring the rotation angle of the movable plate and a control part for controlling the supplying and exhausting of the gas to and from the first inflatable/contractible bag. The control part is configured to control the supplying and exhausting of the gas to and from the first inflatable/contractible bag based on the angle measured by the angle sensor. With such configuration, since the gas supply can be stopped in the case where the first mattress part is changed to the predetermined angle, the first mattress part can be prevented from exceeding the predetermined angle. In addition, since the exhausting of the gas can be stopped in the case where the first mattress part is changed to the predetermined angle, by setting the predetermined angle as 0 degrees, for example, the exhausting of the gas can be stopped when the first mattress part returns to level.

The configuration in which the actuator includes the first inflatable/contractible bag may further include a pressure sensor for measuring a pressure in the first inflatable/contractible bag and a control part for controlling the supplying and exhausting of the gas to and from the first inflatable/contractible bag. The control part is configured to perform control to stop the supplying of the gas to the first inflatable/contractible bag in a case where the pressure in the first inflatable/contractible bag measured by the pressure sensor exceeds a predetermined upper limit value and stop exhausting the gas from the first inflatable/contractible bag in a case where the pressure in the first inflatable/contractible bag measured by the pressure sensor drops below a predetermined lower limit value. With such configuration, the gas supply can be stopped to prevent the first inflatable/contractible bag from being excessively inflated in the case where the pressure of the first mattress part is changed to the predetermined pressure, and the rotation of the first mattress part can be stopped by stopping the exhausting of the gas from the first mattress part in the case where the pressure drops below the predetermined lower limit value.

The mattress according to the first aspect of the disclosure may further include a second inflatable/contractible bag that is inflatable and contractible through supplying or exhausting of gas. The second inflatable/contractible bag is disposed near the first mattress part on a side on which a foot of a person is placed in a longitudinal direction of the mattress body, and is configured to be provided below the second mattress part and supplied with the gas during rotation of the first mattress part. With such configuration, since the step between the first mattress part and the second mattress part can be prevented from being generated, the discomfort of the person lying down with his/her waist being depressed can also be avoided. In addition, by preventing the step between the second mattress part and the first mattress part from being generated, the force can be prevented from concentrating on a portion of the depressed body of the lying person, so pressure sores (bed sores) can be prevented from occurring.

A rotation method according to a second aspect of the disclosure is a rotation method of a mattress including a movable part that includes a rotatably movable plate and an actuator for rotating the movable plate and a mattress body that includes a first mattress part disposed above the movable part, and a second mattress part provided separately from the first mattress part and disposed to surround the first mattress part in a plan view.

The rotation method according to the second aspect of the disclosure includes: rotating the movable plate by the actuator to rotate the first mattress part. Accordingly, in the case where the person is tilted by rotating only the first mattress part, since the person can be supported by the second mattress part that stays level and does not rotate, the person can be prevented from slipping down through the tilting of the first mattress part. As a result, since the person can be prevented from slipping down, the body posture can be changed easily. In addition, differing from the case where the entire mattress is rotated, since the upper/lower movement (vertical movement amount) of the mattress can be prevented from increasing, the lying person and the person nearby can be prevented from having a sense of insecurity.

According to the embodiments of the disclosure, a mattress capable of preventing the person from slipping down when the mattress is tilted and making it easy to change the body posture can be provided.

DESCRIPTION OF THE EMBODIMENTS

Hereinafter, the embodiments embodying the disclosure will be described with reference to the drawings.

First Embodiment

A configuration according to a first embodiment of the disclosure will be described with reference to FIGS. 1 to 12.

Figure 1:
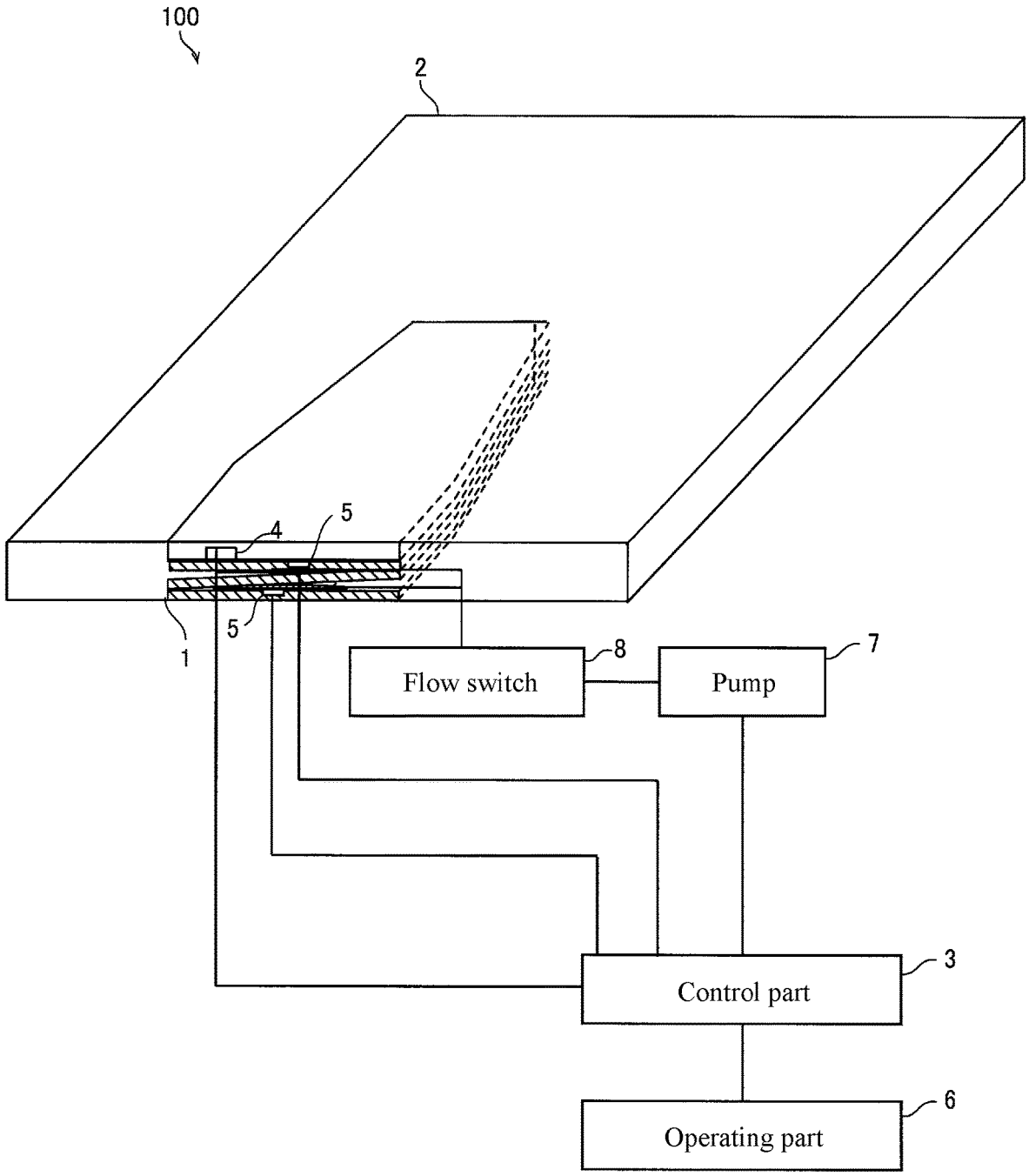
FIG. 1 is a view illustrating a configuration of a mattress according to a first embodiment.

As shown in FIG. 1, a mattress 100 according to the first embodiment includes a movable part 1 and a mattress body 2.

Figure 2:
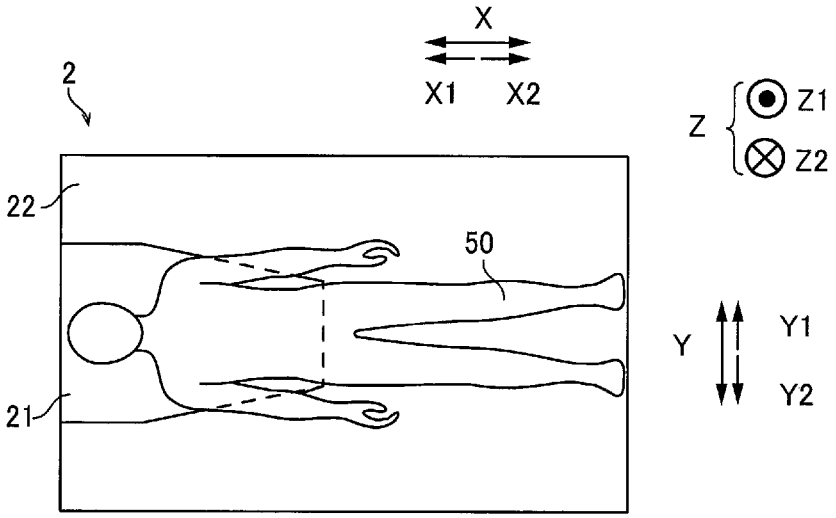
FIG. 2 is a view illustrating a state in which a person is lying on a mattress body according to the first embodiment.

As shown in FIG. 2, a person 50 lies on the mattress main body 2 of the mattress 100 according to the first embodiment. In addition, the mattress 100 has a function of rotating a first mattress part 21 so that the body posture or the clothes of the person 50 lying on the mattress body 2 can be changed.

Figure 3:
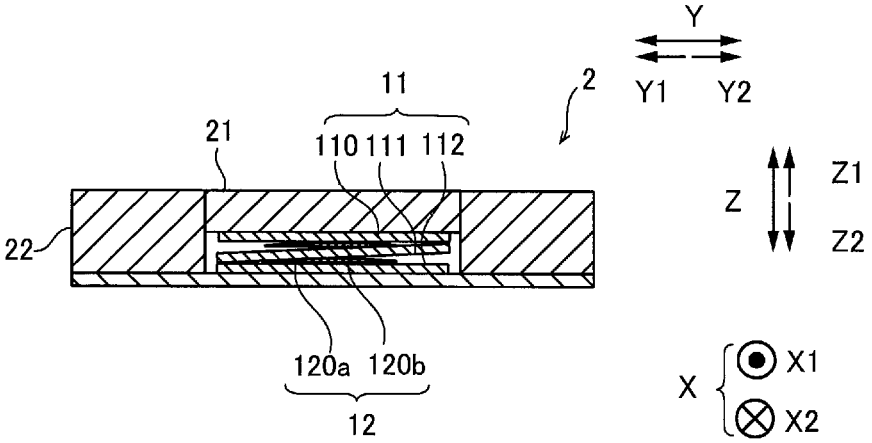
FIG. 3 is a schematic view illustrating a state in which a movable plate is folded according to the first embodiment.

As shown in FIG. 3, the movable part 1 includes a movable plate 11 and an actuator 12. The movable plate 11 includes a first plate member 110, a second plate member 111, and a third plate member 112. The actuator 12 includes a first inflatable/contractible bag 120.

The first plate member 110, the second plate member 111, and the third plate member 112 include plate-like members including a honeycomb structure and a pair of aluminum materials sandwiching the honeycomb structure. The plate member may be a member with an outer shape having a length that is sufficiently large on the plane as compared with the thickness.

The first inflatable/contractible bag 120 is configured to be inflated and contracted by supplying and exhausting a gas (air). The gas to be supplied and exhausted may be oxygen, carbon dioxide, nitrogen and water vapor, or may be a rare gas such as helium, neon and argon, etc. The gas to be supplied and exhausted may also be a mixed gas of the above gases.

The actuator 12 of the first embodiment includes a plurality of first inflatable/contractible bags 120. By inflating or contracting the first inflatable/contractible bag 120 (a first inflatable/contractible bag 120*a*, a first inflatable/contractible bag 120*b*), the rotating direction of the movable plate 11 is changed. The rotation of the movable plate 11 will be described in detail later.

As shown in FIG. 3, the mattress main body 2 includes the first mattress part 21 disposed above the movable part 1 and a second mattress part 22 provided separately from the first mattress part 21 and disposed to surround the first mattress part 21. The first mattress part 21 is rotated upward about a predetermined rotation axis by the movable part 1. The second mattress part 22 is configured so as not to rotate. The specific configuration of the mattress body 2 will be described later.

Figure 4:
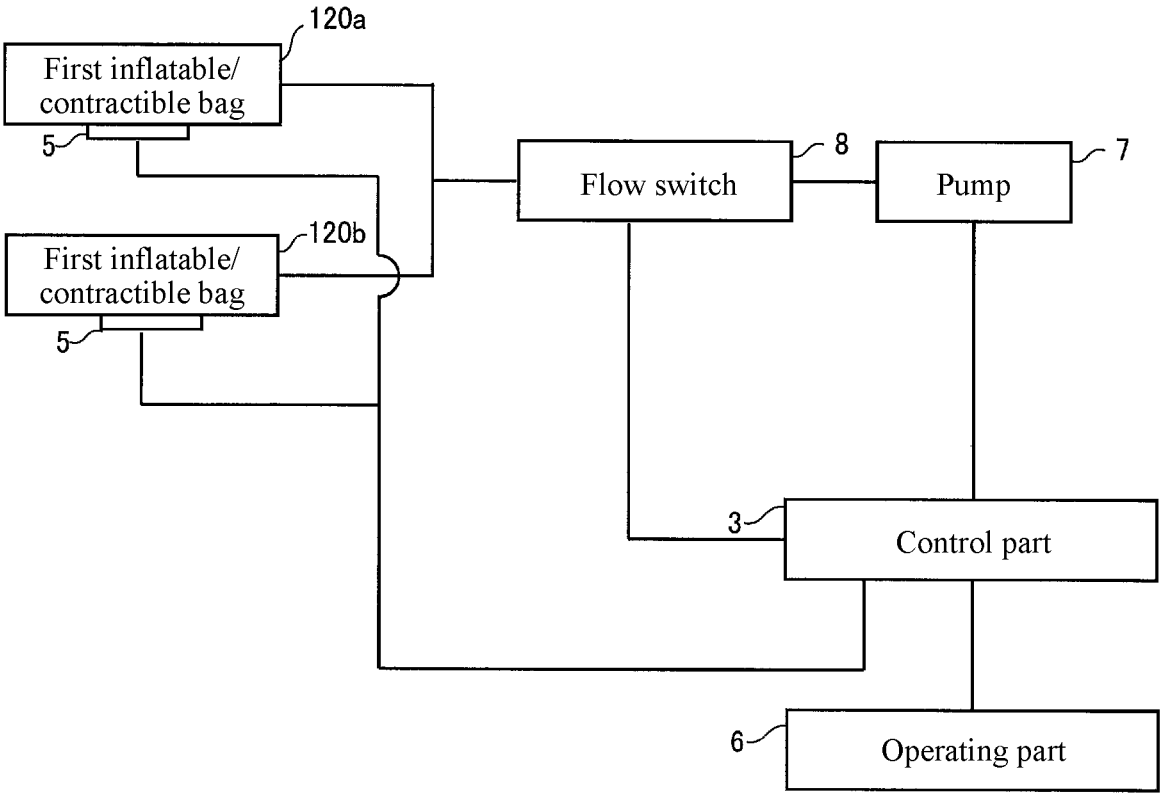
FIG. 4 is a block diagram illustrating a flow path according to the first embodiment.

As shown in FIGS. 1 and 4, the mattress 100 according to the first embodiment further includes a control part 3, an angle sensor 4, a pressure sensor 5, an operating part 6, a pump 7, and a flow path switch 8.

The control part 3 is configured to be capable of receiving a signal from the operating part 6. The control part 3 is configured to receive an operation from the operating part 6 and control the supplying and exhausting of the gas to and from the first inflatable/contractible bag 120. Based on the operation from the operating part 6, the control part 3 controls the flow path switch 8 to switch flow paths to the first inflatable/contractible bag 120 that supplies or exhausts the gas.

The control part 3 is configured to control the pump 7 to inflate or contract the first inflatable/contractible bag 120, so as to rotate the first plate member 110, the second plate member 111, and the third plate member 112 about the rotation axis. In the first embodiment, the first inflatable/contractible bag 120 includes the first inflatable/contractible bag 120*a* provided between the first plate member 110 and the second plate member 111, and the first inflatable/contractible bag 120*b* provided between the second plate member 111 and the third plate member 112.

The angle sensor 4 is provided on the first plate member 110. The angle sensor 4 is a multi-axis sensor for measuring the rotation angle of the movable plate 11. The angle sensor 4 is connected to the control part 3, and is configured to transmit a measured tilting angle of the movable plate 11 to the control part 3. The rotation angle of the movable plate 11 is input via the operating part 6. The angle sensor 4 transmits the measured angle to the control part 3. In the case where the received angle reaches a predetermined angle, the control part 3 controls the pump 7 to stop supplying gas to the first inflatable/contractible bag 120.

The pressure sensor 5 is provided in each of the first inflatable/contractible bag 120*a* and the first inflatable/contractible bag 120*b*. The pressure sensor 5 is a sensor for measuring the pressure inside the first inflatable/contractible bag 120. The pressure sensor 5 is connected to the control part 3 and is configured to send a pressure measurement result to the control part 3.

Figure 5:
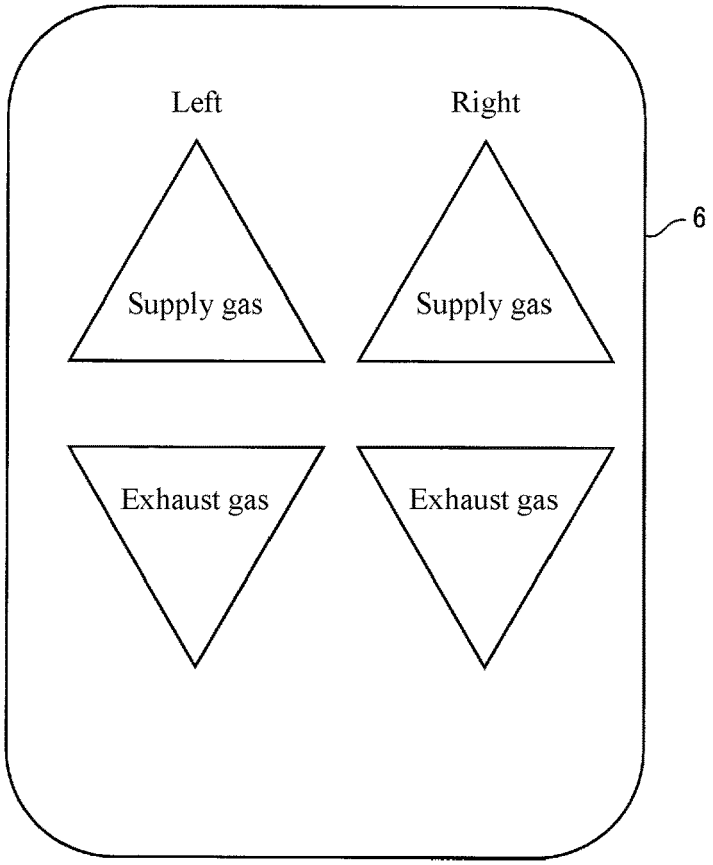
FIG. 5 is a diagram illustrating an example of an operating part according to the first embodiment.

As shown in FIG. 5, the operating part 6 serves to rotate the movable plate 11 to rotate the first mattress part 21. In FIG. 5, the operating part 6 is a push-type switch including switches for air supply and exhaust operations. For example, by pressing the air supply or exhaust button on the right, the first inflatable/contractible bag 120*a* is inflated or contracted, and by pressing the air supply or exhaust button on the left, the first inflatable/contractible bag 120*b* is inflated or contracted. The operating part 6 may be a rotary switch, a foot switch, or the like. The operation received by the operating part 6 is transmitted to the control part 3.

The operating part 6 serves to set an upper limit value and a lower limit value of the pressure of the first inflatable/contractible bag 120. The upper limit value of the pressure of the first inflatable/contractible bag 120 is set to 150 kPa, which is 50 kPa higher than the atmospheric pressure (about 100 kPa), for example. Further, the lower limit value of the pressure of the first inflatable/contractible bag 120 is a value of a negative pressure, and is set to 80 kPa, which is 20 kPa lower than the atmospheric pressure (about 100 kPa), for example.

The pump 7 is configured to supply and exhaust gas (air) to and from the first inflatable/contractible bag 120. For example, pump 7 is a diaphragm pump.

In the case where the gas is supplied from the pump 7 to the first inflatable/contractible bag 120, the control part 3 controls the pump 7 to stop supplying the gas when the value of the pressure received from the pressure sensor 5 exceeds the upper limit value. In the case where air is exhausted from the first inflatable/contractible bag 120 by the pump 7, the control part 3 controls the pump 7 to stop exhausting the gas when the pressure received from the pressure sensor 5 drops below the lower limit value.

The flow path switch 8 is configured to switch the flow paths to the first inflatable/contractible bag 120 for supplying and exhausting gas (air). The flow path switch 8 includes a solenoid valve and is connected to the control part 3.

Figure 6:
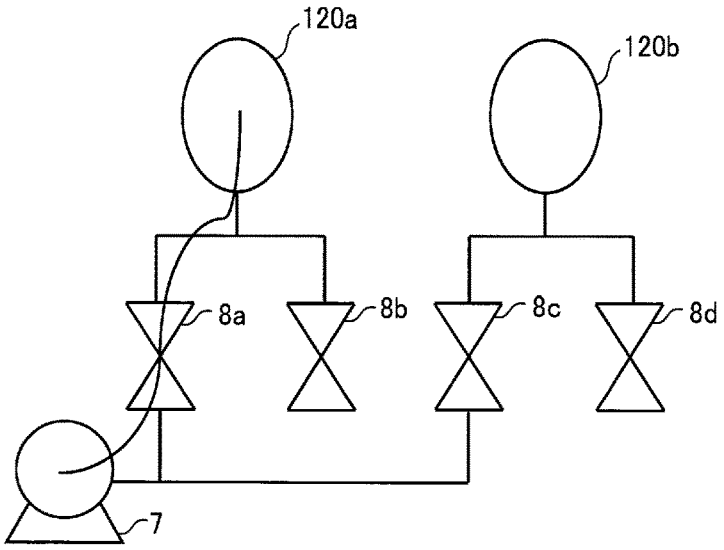
FIG. 6 is a diagram illustrating a flow path for supplying a gas according to the first embodiment.
Figure 7:
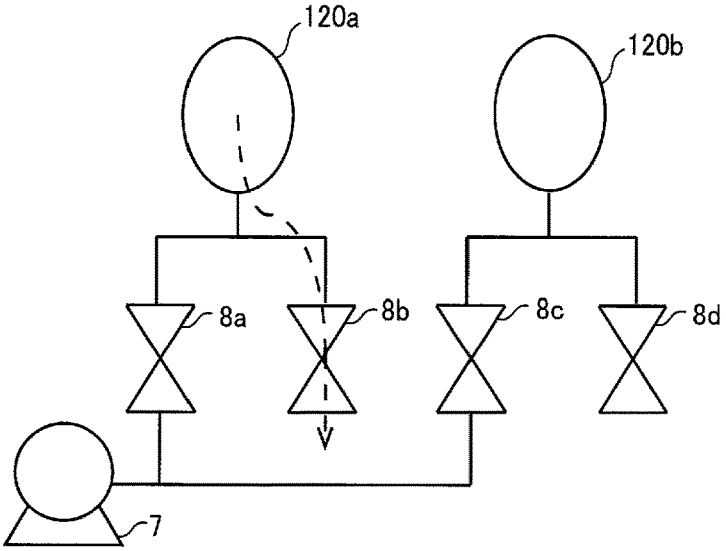
FIG. 7 is a diagram illustrating a flow path for exhausting a gas according to the first embodiment.

As shown in FIGS. 6 and 7, a solenoid valve 8*a* and a solenoid valve 8*c* for supplying the gas are provided on a flow path connecting the pump 7 for supplying gas and the first inflatable/contractible bag 120. In addition, a solenoid valve 8*b* and a solenoid valve 8*d* for exhausting the gas are provided on a flow path for exhausting the gas from the first inflatable/contractible bag 120. In FIG. 6, the gas flow when the gas is supplied is represented in a solid line. For example, in the case of supplying the gas to the first inflatable/contractible bag 120*a*, the control part 3 performs control to turn on the solenoid valve 8*a* and turn off the solenoid valves 8*b*, 8*c*, and 8*d*. Accordingly, the gas is supplied from the pump 7 to the first inflatable/contractible bag 120*a*. In addition, in the case of supplying gas to the first inflatable/contractible bag 120*b*, the control part 3 performs control to turn on the solenoid valve 8*c* and turn off the solenoid valves 8*a*, 8*b*, and 8*d*. Accordingly, the gas is supplied from the pump 7 to the first inflatable/contractible bag 120*b*.

In FIG. 7, the gas flow when the gas is exhausted is represented in a broken line. For example, in the case of exhausting the gas from the first inflatable/contractible bag 120*a*, the control part 3 performs control to turn on the solenoid valve 8*b* and turn off the solenoid valves 8*a*, 8*c*, and 8*d*. Accordingly, the gas is exhausted from the first inflatable/contractible bag 120*a*. In addition, in the case of exhausting the gas from the first inflatable/contractible bag 120*b*, the control part 3 performs control to turn on the solenoid valve 8*d* and turn off the solenoid valves 8*a*, 8*b*, and 8*c*. Accordingly, the gas is exhausted from the first inflatable/contractible bag 120*b*.

(Configuration of Mattress Body)

Figure 8:
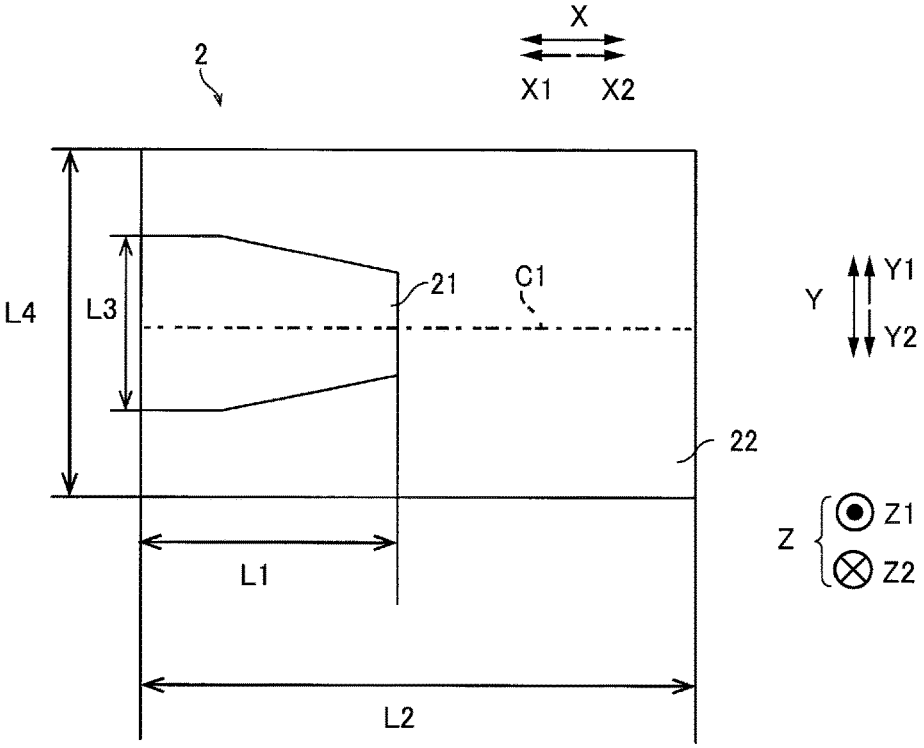
FIG. 8 is a view illustrating the mattress body according to the first embodiment.

As shown in FIGS. 2 and 8, the mattress main body 2 has a rectangular shape having a lateral direction and a longitudinal direction, and is an elongated rectangle in this embodiment. The longitudinal direction of the mattress main body 2 is the X direction, which is a head-foot direction when the person 50 lies down, the X1 side is the head side, and the X2 side is the foot side. The lateral direction is a direction orthogonal to the X direction in a plan view, and the left-right direction of the person 50 is set as the Y direction. The Z direction is the vertical direction orthogonal to the X direction and the Y direction, and the side that is a placing surface on which the person 50 lies is the Z1 side.

As shown in FIG. 8, the first mattress part 21 has a hexagonal shape having a longitudinal direction and a lateral direction. In the first embodiment, the lateral direction and the longitudinal direction of the first mattress part 21 are the same as the lateral direction and the longitudinal direction of the mattress body 2. With the lateral direction of the first mattress part 21 being consistent with the lateral direction of the mattress body 2, the first mattress part 21 can contact a wide range of the person lying on the mattress body 2 in the head-foot direction. The first mattress part 21 is disposed on the side (X1 side) on which the head part of the person 50 is placed in the longitudinal direction (X direction) of the mattress body 2.

The second mattress part 22 has a shape defined by cutting out the first mattress part 21 from the mattress body 2. The second mattress part 22 is disposed on both ends (Y1 side and Y2 side) in the lateral direction (Y direction) of the mattress body 2 and the X2 side, so as to sandwich the first mattress part 21.

The first mattress part 21 is disposed on a center line C1 that extends in the longitudinal direction (X direction) of the mattress body 2 and passes through the center of the mattress body 2 in the lateral direction (Y direction). When the center line C1 is aligned with a center line C2 extending in the longitudinal direction (X direction) of the mattress body 2 passing through the center of the first mattress part 21 in the lateral direction (Y direction), the sizes of the areas of the second mattress part 22 on both ends (Y1 side and Y2 side) in the lateral direction (Y direction) of the mattress body 2 can be made the same, so as to sandwich the first mattress portion 21.

A length L1 of the first mattress part 21 in the longitudinal direction (X direction) is a half or less of a length L2 of the mattress body 2 in the longitudinal direction (X direction). For example, since the length of a hospital bed in the longitudinal direction is normally 191 cm, the length of the first mattress part 21 in the longitudinal direction is 95.5 cm or less. In addition, in the case where the mattress 100 is used in a bed having a back raising function for raising the upper body of the person 50, the length of the first mattress part 21 in the longitudinal direction is set so as not to interfere with the back raising function.

A maximum length L3 of the first mattress part 21 in the lateral direction (Y direction) is two thirds of a length L4 of the mattress body 2 in the lateral direction (Y direction) or less. For example, since the length of a hospital bed in the lateral direction is normally 830 mm, the maximum length of the first mattress part 21 in the lateral direction is 553 mm or less. Further, considering the average adult shoulder width, the maximum length L3 of the first mattress part 21 in the lateral direction (X direction) may be set to be 200 mm or more and 450 mm or less.

(Configuration of Plate Members and Inflatable/Contractible Bag)

Figure 9:
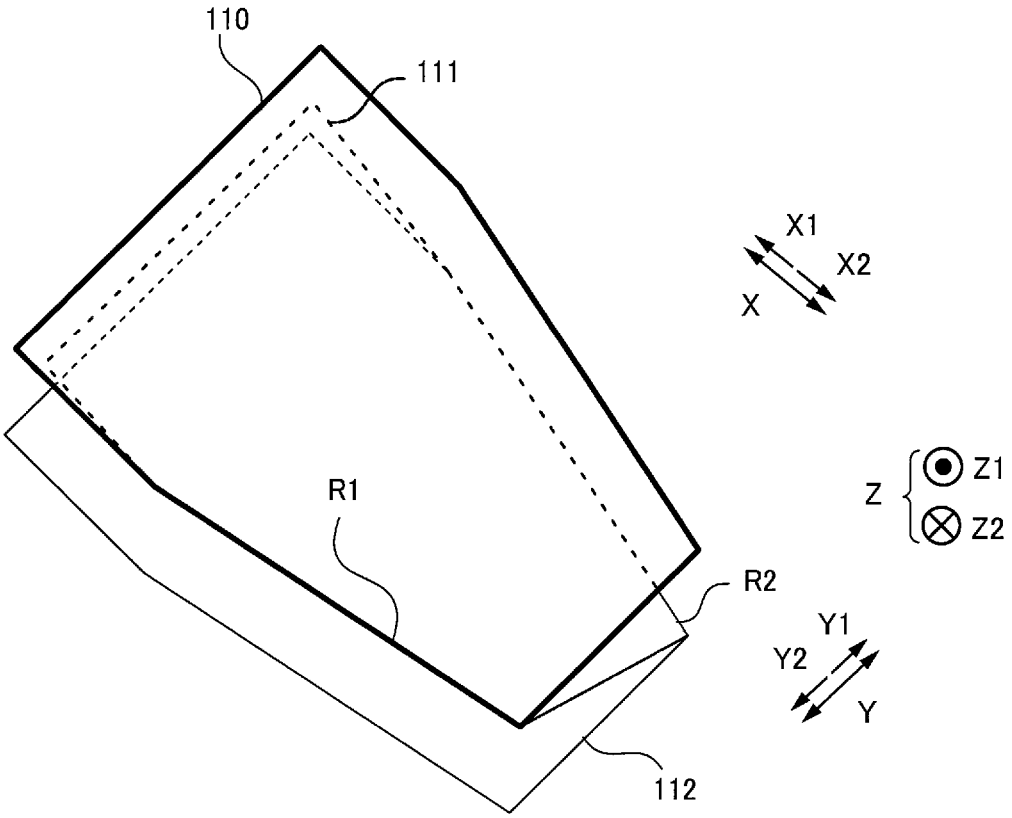
FIG. 9 is a view illustrating a configuration of the movable plate according to the first embodiment.

As shown in FIGS. 3 and 9, the movable plate 11 is disposed on below (Z2 side) the first mattress part 21. The movable plate 11 includes the first plate member 110 disposed on the side (Z1 side) on which the first mattress part 21 is disposed, the second plate member 111 which is disposed below the first plate member 110 and rotatably connected with the first plate member 110 by a first rotation center axis R1, the first inflatable/contractible bag 120*a* that is disposed between the first plate member 110 and the second plate member 111 and is inflatable and contractible through supplying and exhausting the gas (air), the third plate member 112 which is disposed below the second plate member 111 and rotatably connected with the second plate member 111 by a second rotation center axis R2 different from the first rotation center axis R1, and the first inflatable/contractible bag 120*b* that is disposed between the second plate member 111 and the third plate member 112 and is inflatable and contractible through supplying and exhausting the gas (air), Regarding the method for connecting the first plate member 110, the second plate member 111, and the third plate member 112, the plate members may each be wrapped with a sheet, and the sheets may be bonded together, or the plate members may be directly connected by a hinge, etc.

In addition, the first plate member 110, the first inflatable/contractible bag 120*a*, the second plate member 111, the first inflatable/contractible bag 120*b*, and the third plate member 112 are disposed so as to overlap each other in a plan view. By inflating the first inflatable/contractible bag 120 (the first inflatable/contractible bag 120*a*, the first inflatable/contractible bag 120*b*), the first plate member 110 is pushed up and rotated obliquely about the rotation axis.

Figure 10:
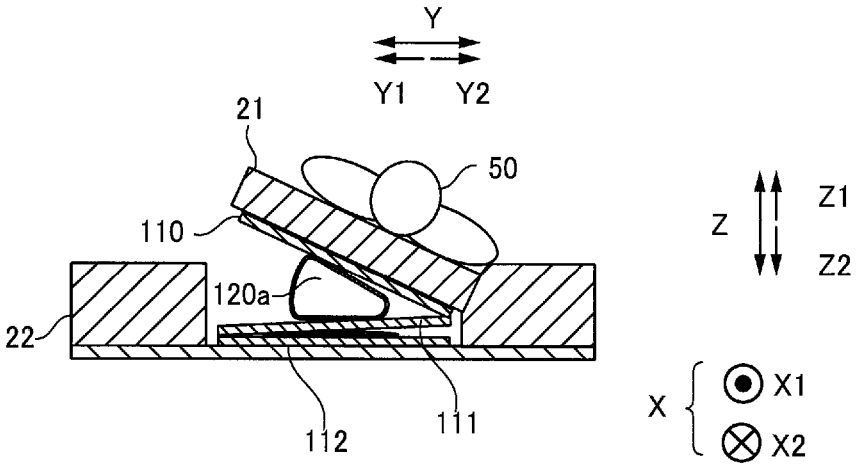
FIG. 10 is a schematic view illustrating that a first mattress part is tilted in a direction according to the first embodiment.
Figure 11:
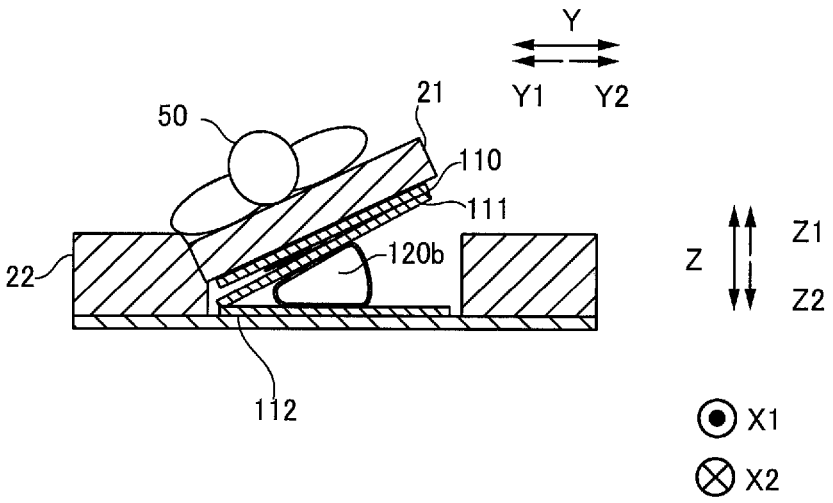
FIG. 11 is a schematic view illustrating that the first mattress part is tilted in another direction according to the first embodiment.

As shown in FIGS. 10 and 11, in the case where the first inflatable/contractible bag 120*a* is inflated, the first mattress part 21 is rotated about the first rotation center axis by rotating the first plate member 110. In the case where the first inflatable/contractible bag 120*b* is inflated, the second plate member 111 and the first plate member 110 are rotated about the second rotation center axis. At this time, the maximum tilting angle of the first mattress part 21 may be 20 degrees or more and 60 degrees or less with respect to the horizontal plane, and may be more 40 degrees or more and 50 degrees or less.

As shown in FIG. 10, in the case where air is supplied to the first inflatable/contractible bag 120*a* disposed between the first plate member 110 and the second plate member 111, the first plate member 110 is pushed up (in the Z1 direction) and rotated about the first rotation center axis R1. The first mattress part 21 bites into the second mattress part 22 through rotation. Accordingly, the surface of the Z1 side of the second mattress part 22 contacts the person 50, thereby preventing the person 50 from slipping down.

As shown in FIG. 11, in the case where air is supplied to the first inflatable/contractible bag 120 disposed between the second plate member 111 and the third plate member 112, the second plate member 111 is pushed up (in the Z1 direction) and rotated about the second rotation center axis R2. The first mattress part 21 bites into the second mattress part 22 through oblique rotation. Accordingly, the surface of the Z1 side of the second mattress part 22 contacts the person 50, thereby preventing the person 50 from slipping down.

Figure 12:
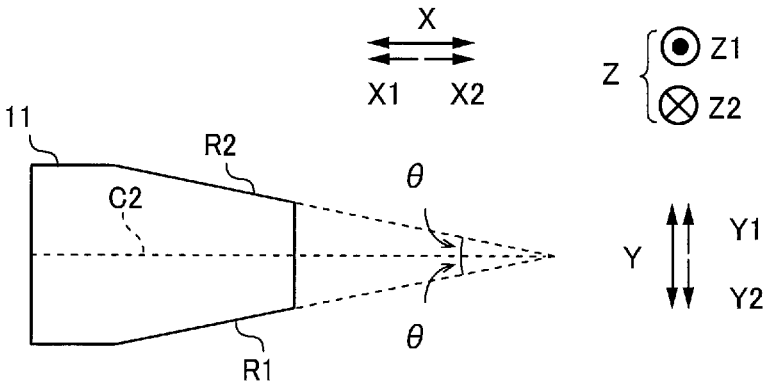
FIG. 12 is a view illustrating a first rotation center axis and a second rotation center axis of the movable plate according to the first embodiment.

As shown in FIG. 12, the first rotation center axis R1 and the second rotation center axis R2 are tilted at an angle of 0 degrees with respect to the center line C2 that extends in the longitudinal direction and passes through the center of the movable plate 11 in the lateral direction in a plan view. The tilting angle with respect to the center line C2 may be 10 degrees or more and 15 degrees or less. In the first embodiment, from the X1 direction to the X2 direction, the rotation center axis tilted toward the Y1 side is set as the first rotation center axis R1, and the rotation center axis tilted toward the Y2 side is set as the second rotation center axis R2.

In the first embodiment, the first plate member 110, the second plate member 111, and the third plate member 112 have substantially the same shape as the first mattress part 21 in a plan view. In addition, in the first embodiment, the first plate member 110, the second plate member 111, and the third plate member 112 have the same size.

Figure 13:
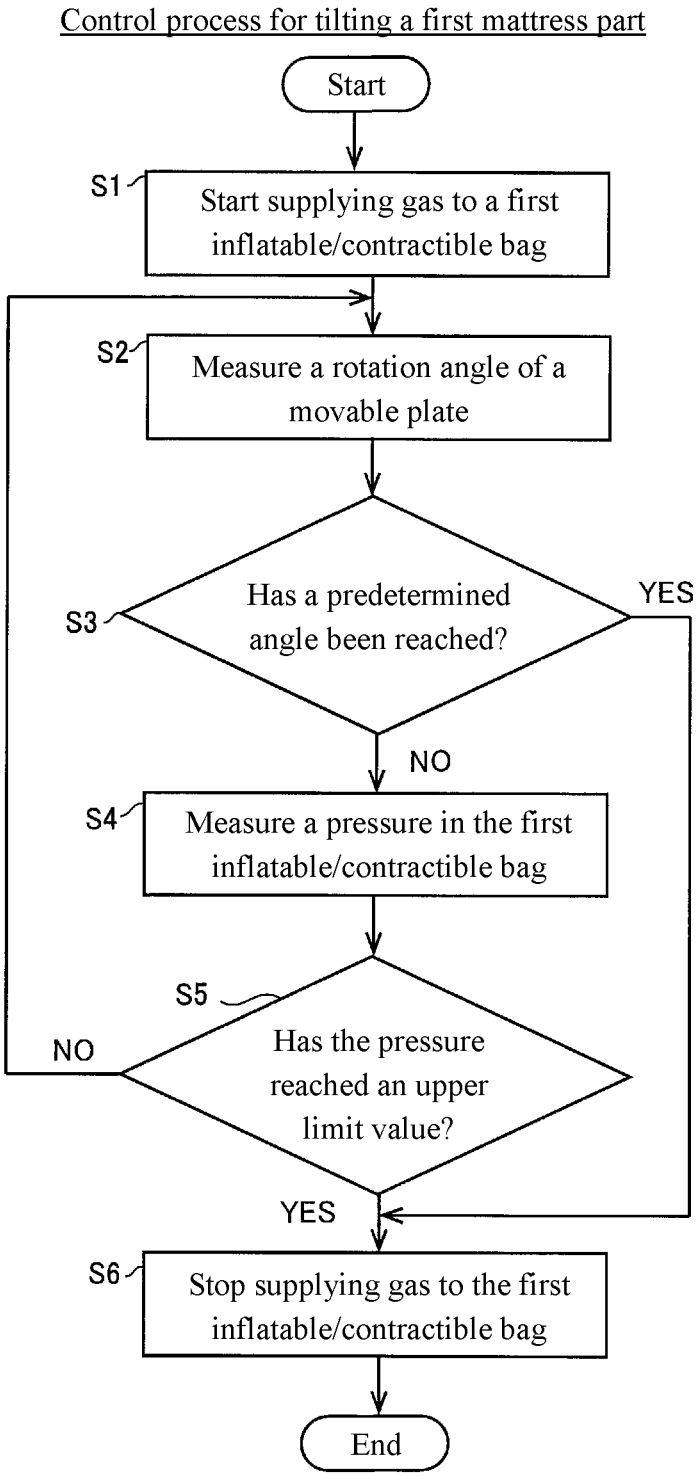
FIG. 13 is a flowchart illustrating a rotation process of the first mattress part according to the first embodiment.

The air supply to the first inflatable/contractible bag 120*a* will be described with reference to FIG. 13. First, in Step S1, the control part 3 controls the pump 7 to start supplying gas to the first inflatable/contractible bag 120*a*. In Step S2, the control part 3 receives the rotation angle of the movable plate 11 measured by the angle sensor 4. In Step S3, the next step differs depending on whether the rotation angle of the movable plate 11 transmitted from the angle sensor 4 reaches a predetermined magnitude. In the case where the rotation angle of the movable plate 11 reaches the predetermined angle, Step S6 is performed. In the case where the rotation angle of the movable plate 11 does not reach the predetermined angle, the gas supply continues and Step S4 is performed.

In Step S4, the control part 3 receives the value of the pressure in the first inflatable/contractible bag 120*a* measured by the pressure sensor 5. In Step S5, the step to be performed differs depending on whether the pressure measured by the pressure sensor 5 reaches an upper limit value. In the case where the pressure measured by the pressure sensor 5 reaches the upper limit value, in Step S6, the control part 3 controls the pump 7 to stop supplying the gas to the first inflatable/contractible bag 120*a*. In the case where the pressure measured by the pressure sensor 5 does not reach the upper limit value, the gas supply continues, and the flow returns to Step 2. Step S3 and Step S5 may be performed simultaneously.

(Effects of First Embodiment) In the first embodiment, the following effects can be obtained.

In the first embodiment, as described above, the mattress 100 includes the movable part 1 and the mattress body 2. The mattress body 2 includes the first mattress part 21 disposed above the movable part 1, and the second mattress part 22 provided separately from the first mattress part 21 and disposed to surround the first mattress part 21 in a plan view. The first mattress part 21 is configured so as to rotate upward about the predetermined rotation axis by the movable part 1. Accordingly, in the case where the person 50 is tilted by rotating only the first mattress part 21, since the person 50 can be supported by the second mattress part 22 that stays level and does not rotate, the person 50 can be prevented from slipping down through the tilting of the first mattress part 21. As a result, since the person 50 can be prevented from slipping down, the body posture can be changed easily. In addition, differing from the case where the entire mattress 100 is rotated, since the upper/lower movement (vertical movement amount) of the mattress 100 can be prevented from increasing, the lying person 50 and the person 50 nearby can be prevented from having a sense of insecurity.

In the first embodiment, as described above, the mattress body 2 has a rectangular shape having a lateral direction and a longitudinal direction, and the second mattress part 22 is disposed on both ends of the mattress body 2 in the lateral direction to sandwich the first mattress part 21 in a plan view. Accordingly, the second mattress part 22 can be sufficiently disposed on both ends of the mattress body 2 in the lateral direction. Accordingly, since a portion of the person 50 can be supported by the second mattress part 22 that stays level and does not rotate even in the case where the first mattress part 21 is rotated in the direction of one of one end or the other end side in the lateral direction of the mattress body 2, the body posture can be changed on the left or the right in a plan view.

In the first embodiment, as described above, the second mattress part 22 is configured to not rotate. Accordingly, since the second mattress part 22 stays level and does not rotate when the first mattress part 21 is rotated, the space for supporting the body when the body posture is changed can be ensured.

In the first embodiment, as described above, the movable plate 11 has a shape having a lateral direction and a longitudinal direction, and has a rotation center axis tilted with respect to the center line C2 that extends in the longitudinal direction and passes through the center of the movable plate 11 in the lateral direction in a plan view. Since the rotation center axis is tilted with respect to the center line C2 that extends in the longitudinal direction of the movable plate 11 in a plan view, the movable plate 11 can be rotated obliquely with respect to the center line C2 that extends in the longitudinal direction of the movable plate 11.

In the first embodiment, as described above, the movable plate 11 includes the first rotation center axis R1 and the second rotation center axis R2, the first rotation center axis R1, in a plan view, is tilted in a direction with respect to the center line C2 that extends in the longitudinal direction and passes through the center of the movable plate 11 in the lateral direction, and the second rotation center axis R2, in a plan view, is tilted in another direction with respect to the center line C2 that extends in the longitudinal direction and passes through the center of the movable plate 11 in the lateral direction. Accordingly, since the first rotation center axis R1 or the second rotation center axis R2, in a plan view, is tilted in one direction or another direction with respect to the center line C2 that extends in the longitudinal direction of the movable plate 11, when the person 50 lies on the first mattress part 21 along the longitudinal direction of the movable plate 11, the person 50 can be tilted sideways while being tilted forward and rotated through the rotation about the first rotation center axis R1 or the second rotation center axis R2 that is tilted in a plan view. Accordingly, since the shoulder position of the person 50 can be higher than the waist position, the body posture can be changed easily in the case of rotating in the left or right direction.

In the first embodiment, as described above, the first rotation center axis R1 is tilted at a tilting angle of 10 degrees or more and 15 degrees or less in a direction with respect to the center line C2 in a plan view, and the second rotation center axis R2 is tilted at a tilting angle of 10 degrees or more and 15 degrees or less in another direction with respect to the center line C2 in a plan view. Accordingly, with the tilting angle being 10 degrees or more and 15 degrees or less, the person 50 can be suitably tilted forward while being tilted sideways.

In the first embodiment, as described above, the movable plate 11 has the first plate member 110 and the second plate member 111 disposed below the first plate member 110 and rotatably connected with the first plate member 110 by the first rotation center axis R1. Accordingly, one of the first plate member 110 and the second plate member 111 can be fixed to the member on which the mattress body 2 is placed, and the other can be fixed to the first mattress part 21. As a result, the first plate member 110 can be rotated with the second plate member 111 as a reference.

In the first embodiment, as described above, the third plate member 112 disposed below the second plate member 111 and rotatably connected with the second plate member 111 by the second rotation center axis R2 different from the first rotation center axis R1 is further provided. In a plan view, the first plate member 110, the second plate member 111, and the third plate member 112 are disposed to overlap each other. Accordingly, since the directions in which the first plate member 110 and the second plate member 111 are rotated can be different, for example, the body posture of the person 50 can be changed between left and right. Further, in the plan view, with the first plate member 110, the second plate member 111, and the third plate member 112 being disposed to overlap each other, the space for disposing the movable plate 11 in a plan view can be reduced.

In the first embodiment, as described above, the first mattress part 21 is disposed on the center line C1 that extends in the longitudinal direction of the mattress body 2 and passes through the center of the mattress body 2 in the lateral direction. Accordingly, since the first mattress part 21 can be disposed on the center line of the person 50, the first mattress part 21 can push up the person 50 along the spine to change the body posture. As a result, for example, compared with the case of pushing up the side part, such as the flank, of the person 50, the body posture can be changed easily.

In the first embodiment, as described above, the first mattress body 21 has a shape having a lateral direction and a longitudinal direction, the length of the first mattress part 21 in the longitudinal direction is a half or less of the length of the mattress body 2 in the longitudinal direction, and the first mattress part 21 is disposed on the side on which the head part of the person 50 is placed in the longitudinal direction of the mattress body 2. Accordingly, for example, in the case of being used with a bed having a back raising function for raising the upper body of the person 50, the first mattress part 21 can be prevented from being disposed over a position at which the first mattress part 21 is bent by the back raising function.

In the first embodiment, as described above, the first mattress part 21 has the maximum length in the lateral direction that is two thirds or less of the length of the mattress body 2 in the lateral direction. Accordingly, since the length of the second mattress part 22 in the lateral direction is one third or more of the length of the mattress body 2 in the lateral direction, the length of the second mattress part 22 can be sufficiently ensured. As a result, the space for changing the body posture can be ensured.

In the first embodiment, as described above, the first mattress part 21 has the maximum length in the lateral direction that is 200 mm or more and 450 mm or less. Accordingly, with the maximum length in the lateral direction being 200 mm or more, the length of the first mattress part 21 in the lateral direction can be sufficiently ensured, and the person 50 can be rotated even in the case where an individual difference is present. In addition, with the maximum length in the lateral direction being 450 mm or less, since the length of the first mattress part 21 in the lateral direction can be prevented from being greater than the shoulder width of the person 50, the person 50 can be prevented from slipping down from the first mattress part 21.

In the first embodiment, as described above, the actuator 12 includes the first inflatable/contractible bag 120 that is inflatable and contractible through supplying or exhausting of the gas, and the movable plate 11 is configured to adjust the rotation angle through supplying or exhausting of the gas to or from the first inflatable/contractible bag 120. Accordingly, by supplying and exhausting the gas, the rotation angle can be adjusted, so the configuration of the mattress 100 can be simplified.

In the first embodiment, as described above, the maximum tilting angle of the first mattress part 21 is 20 degrees or more and 60 degrees or less with respect to the horizontal plane. Accordingly, with the maximum tilting angle of the first mattress part 21 being 60 degrees or less, the rotation angle can be prevented from being excessively large. In addition, with the maximum tilting angle of the first mattress part 21 being 20 degrees or more, the person 50 can be tilted sufficiently, so the operation can be easy in the case of changing the body posture.

In the first embodiment, as described above, the angle sensor 4 for measuring the rotation angle of the movable plate 11 and the control part 3 for controlling the supplying and exhausting of the gas to and from the first inflatable/contractible bag 120 are further provided, and the control part 3 is configured to control to supply and exhaust the gas to and from the first inflatable/contractible bag 120 based on the angle measured by the angle sensor 4. Accordingly, since the gas supply can be stopped in the case where the first mattress part 21 is changed to the predetermined angle, the first mattress part 21 can be prevented from exceeding the predetermined angle. In addition, since the exhausting of the gas can be stopped in the case where the first mattress part 21 is changed to the predetermined angle, by setting the predetermined angle as 0 degrees, for example, the exhausting of gas can be stopped when the first mattress part 21 returns to level.

In the first embodiment, as described above, the pressure sensor 5 for measuring the pressure in the first inflatable/contractible bag 120 and the control part 3 for controlling the supplying and exhausting of the gas to and from the first inflatable/contractible bag 120 is further provided. In the case where the pressure in the first inflatable/contractible bag 120 measured by the pressure sensor 5 exceeds the predetermined upper limit value, the control part 3 controls to stop the gas supply to the first inflatable/contractible bag 120, and in the case where the pressure in the first inflatable/contractible bag 120 measured by the pressure sensor 5 drops below the predetermined lower limit value, the control part 3 controls to stop the exhausting of gas from the first inflatable/contractible bag 120. Accordingly, the gas supply can be stopped to prevent the first inflatable/contractible bag 120 from being excessively inflated in the case where the pressure of the first mattress part 21 is changed to the predetermined pressure, and the rotation of the first mattress part 21 can be stopped by stopping the exhausting of gas from the first mattress part 21 in the case where the pressure drops below the predetermined lower limit value.

Second Embodiment

Figure 14:
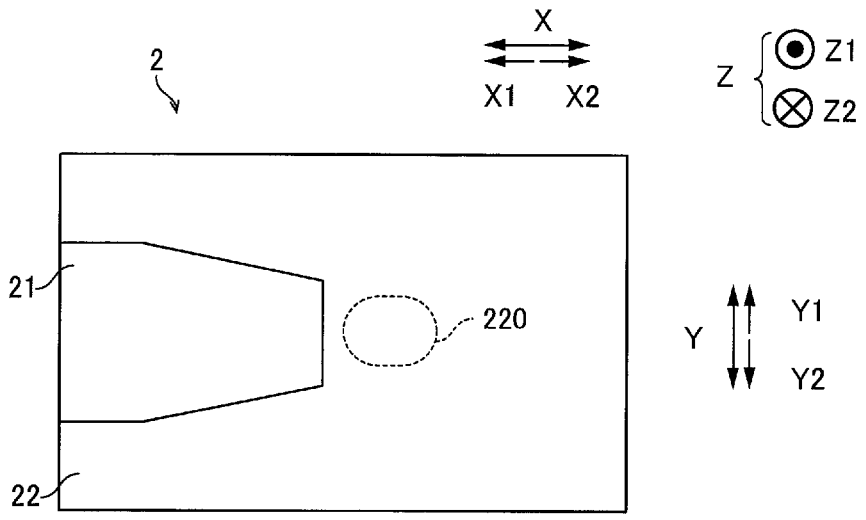
FIG. 14 is a schematic view illustrating a mattress body according to a second embodiment.

Next, a second embodiment will be described with reference to FIG. 14. In the second embodiment, in addition to the configuration of the first embodiment, the mattress main body 2 further includes a second inflatable/contractible bag 220. The parts same as those in the first embodiment are designated by the same reference numerals.

The second inflatable/contractible bag 220 is disposed near the first mattress part 21 on the side on which the foot of the person 50 is placed in the longitudinal direction of the mattress body 2 and is provided below the second mattress part 22. The second inflatable/contractible bag 220 is disposed, for example, around the buttocks of the person 50.

The second inflatable/contractible bag 220 is configured to be supplied with gas when the first mattress part 21 is rotated. Like the first inflatable/contractible bag 120, the second inflatable/contractible bag 220 is also connected with the pump 7. In the case where the second inflatable/contractible bag 220 is supplied with gas, the gas supply is configured to stop when the gas is supplied for a predetermined time. With the second inflatable/contractible bag 220 being inflated, a portion of the second mattress part 22 is lifted, and the step between the first mattress part 21 and the second mattress part 22 can be reduced. The second inflatable/contractible bag 220 is contracted due to exhausting of the gas from the pump 7.

Other configurations in the second embodiment are the same as those of the first embodiment.

(Effects of Second Embodiment)

In the second embodiment, the following effects can be obtained.

In the second embodiment, like the first embodiment, in the case where the person 50 is tilted by rotating only the first mattress part 21, since the person 50 can be supported by the second mattress part 22 that stays level and does not rotate, the person 50 can be prevented from slipping down through the tilting of the first mattress part 21. As a result, since the person 50 can be prevented from slipping down, the body posture can be changed easily. In addition, differing from the case where the entire mattress 100 is rotated, since the upper/lower movement (vertical movement amount) of the mattress 100 can be prevented from increasing, the lying person 50 and the person 50 nearby can be prevented from having a sense of insecurity.

In the second embodiment, as described above, the second inflatable/contractible bag 220 that is inflatable and contractible through supplying or exhausting of the gas is further provided, and the second inflatable/contractible bag 220 is disposed near the first mattress part 21 on the side on which the foot of the person 50 is placed in the longitudinal direction of the mattress body 2, provided below the second mattress part 22, and configured to be supplied with gas when the first mattress part 21 is rotated. Accordingly, since the step between the first mattress part 21 and the second mattress part 22 can be prevented from being generated, the discomfort of the person 50 lying down with his/her waist being depressed can also be alleviated. In addition, by preventing the step between the second mattress part 22 and the first mattress part 21 from being generated, the force can be prevented from concentrating on a portion of the depressed body of the lying person 50, so pressure sores (bed sores) can be prevented from occurring.

Other effects of the second embodiment are the same as those of the first embodiment.

Modified Examples

It should be understood that the embodiments disclosed herein are exemplifications in all points and shall not be considered as restrictive. The scope of the disclosure shall not be defined by the above description of the embodiments but by the scope of the claims, and further includes those bearing equivalent meanings to the scope of the claims as well as all modifications (modified examples) within the scope.

For example, in the first and second embodiments, an example in which the movable plate includes the first plate member, the second plate member, and the third plate member is described, but the disclosure is not limited thereto. In the disclosure, the movable plate may include only the first plate member and the second plate member. In this case, the first inflatable/contractible bag may be provided between the first plate member and the second plate member and between the second plate member and the surface on which the mattress is placed.

In addition, in the first and second embodiments, an example in which the first mattress part is hexagonal is described, but the disclosure is not limited thereto. In the disclosure, the first mattress part may have other polygonal shapes.

In addition, in the first and second embodiments, although an example in which the first plate member, the second plate member, and the third plate member have the same size is described, the disclosure is not limited thereto. In the disclosure, the first plate member, the second plate member, and the third plate member may also have different sizes. The second plate member may be smaller than the first plate member.

In addition, in the first and second embodiments, an example in which the angle sensor and the pressure sensor are provided is described. However, the disclosure is not limited thereto. In the disclosure, it may also be that one of the angle sensor and the pressure sensor is provided.

For example, in the first and second embodiments, an example in which the control part exerts control based on the value set by the operation of the operating part is described. However, the disclosure is not limited thereto. In the disclosure, the control part may also exert control based on a setting value set in advance.

In addition, in the first and second embodiments, an example in which the first rotation center axis and the second rotation center axis are tilted with respect to the center line in a plan view is described. However, the disclosure is not limited thereto. In the disclosure, it may also be that the first rotation center axis and the second rotation center axis are not tilted with respect to the center line in a plan view.

In addition, in the first and second embodiments, an example in which the first rotation center axis and the second rotation center axis extend along the X direction is described. However, the disclosure is not limited thereto. In the disclosure, it may also be that the first rotation center axis and the second rotation center axis extend in the Y direction.

In addition, in the first and second embodiments, an example in which the actuator includes the first inflatable/contractible bag is described. However, the disclosure is not limited thereto. In the disclosure, the actuator may also include a lifting device, such as a jack, other than the first inflatable/contractible bag.

Figure 15:
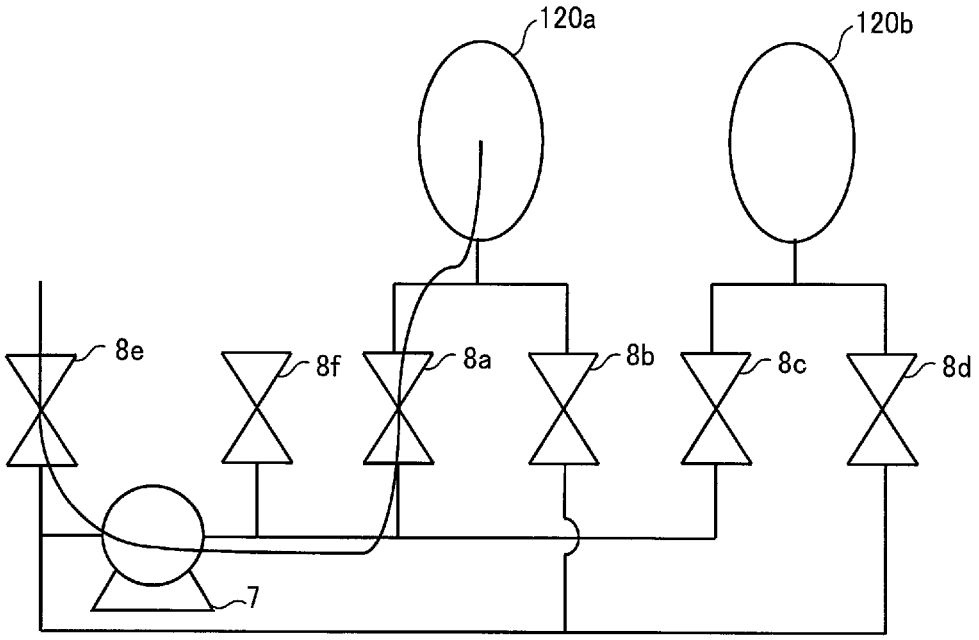
FIG. 15 is a diagram illustrating a flow path for supplying a gas according to a modified example.

In addition, in the first and second embodiments, an example in which one solenoid valve is used for gas supply is described. However, the disclosure is not limited thereto. In the disclosure, it may also be that multiple solenoid valves are used for gas supply. For example, as shown in FIG. 15, in the case where the gas is supplied to the first inflatable/contractible bag, the control part performs control to turn on the solenoid valve 8*a* and a solenoid valve 8*e* and turn off the solenoid valve 8*b*, the solenoid valve 8*c*, the solenoid valve 8*d*, and a solenoid valve 8*f*. Accordingly, the gas is more powerfully supplied from the pump 7 to the first inflatable/contractible bag.

Figure 16:
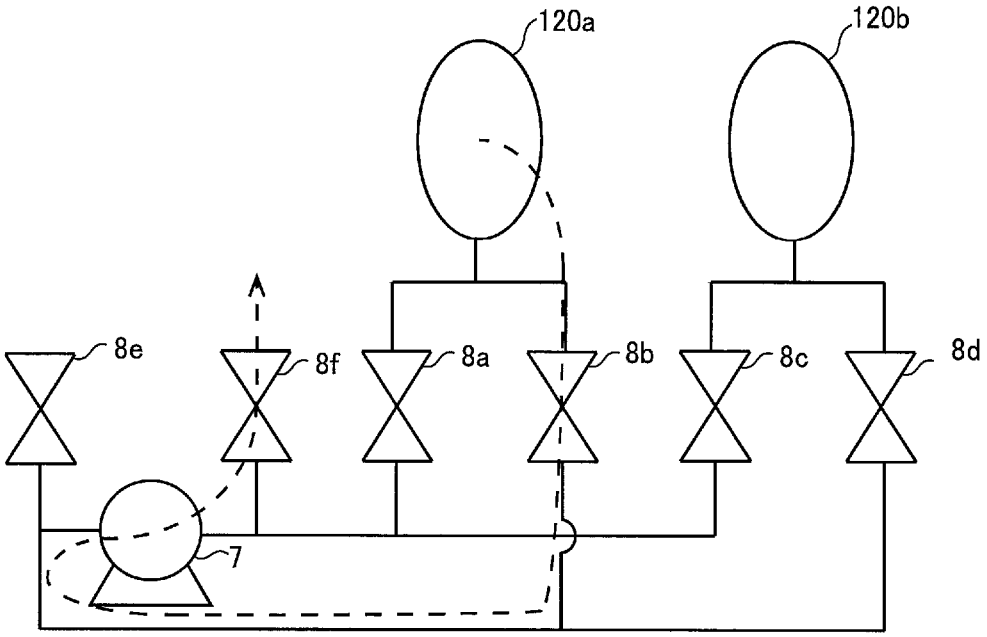
FIG. 16 is a diagram illustrating a flow path for exhausting a gas according to a modified example.

In addition, in the first and second embodiments, an example with a pump capable of supplying gas is described. However, the disclosure is not limited thereto. In the disclosure, a pump capable of inhaling and exhausting gas may also be used. For example, as shown in FIG. 16, in the case where gas is exhausted from the first inflatable/contractible bag, the control part performs control to turn on the solenoid valve 8*b* and the solenoid valve 8*f* and turn off the solenoid valve 8*a*, the solenoid valve 8*c*, the solenoid valve 8*d*, and the solenoid valve 8*e*. Accordingly, the gas can be more powerfully exhausted from the first inflatable/contractible bag by the pump 7.

Moreover, in the first embodiment, for the ease of description, a flow-driven type flowchart that performs the processes successively according to a process flow is used to describe the rotation of the first mattress part of the control part of the disclosure, the disclosure is not limited thereto. In the disclosure, the processing operations performed by the control part may also be performed according to event-driven type processes with which processes are executed on an event-by-event basis. In such case, the processes may be entirely event-driven or a combination of the event-driven type and the flow-driven type.

What is claimed is:

1. A mattress, comprising:

a movable part, comprising a rotatably movable plate and an actuator for rotating the movable plate, wherein the actuator comprises a first inflatable/contractible bag that is inflatable and contractible through supplying or exhausting of gas, and the movable plate is configured to adjust a rotation angle through supplying or exhausting of the gas to and from the first inflatable/contractible bag;

a mattress body, comprising a first mattress part disposed above the movable part, and a second mattress part provided separately from the first mattress part and disposed to surround the first mattress part in a plan view;

an angle sensor for measuring the rotation angle of the movable plate; and a control part for controlling the supplying and exhausting of the gas to and from the first inflatable/contractible bag, wherein the control part is configured to control the supplying and exhausting of the gas to and from the first inflatable/contractible bag based on the angle measured by the angle sensor, wherein the first mattress part is configured to be rotated upward about a predetermined rotation axis by the movable part, wherein the movable plate has a shape having a lateral direction and a longitudinal direction, and the movable plate has at least one rotation center axis tilted with respect to a center line that extends in the longitudinal direction and passes through a center of the movable plate in the lateral direction in the plan view, wherein the at least one rotation center axis is tilted at an angle with respect to the center line, the angle is more than 0 degree and is less than 90 degrees, and the at least one rotation center axis passes through the center line at the angle, wherein the mattress body has a rectangular shape having a short side along a lateral direction and a long side along a longitudinal direction, and the first mattress part has a shape having a lateral direction and a longitudinal direction, wherein the first mattress part has a first side and a second side parallel and opposite to each other along the lateral direction, the length of the first side is greater than the length of the second side, the first side is located on the short side of the mattress body, and an orthogonal projection of the at least one rotation center axis of the movable plate on the first mattress part passes through an orthogonal projection of the second side on the first mattress part.

2. The mattress as claimed in claim 1, wherein the second mattress part is disposed on both ends of the mattress body in the lateral direction to sandwich the first mattress part in the plan view.

3. The mattress as claimed in claim 1, wherein the second mattress part is configured so as not to rotate.

4. The mattress as claimed in claim 1, wherein the at least one rotation center axis of the movable plate comprises a first rotation center axis and a second rotation center axis, the first rotation center axis, in the plan view, is tilted in a direction with respect to the center line that extends in the longitudinal direction and passes through the center of the movable plate in the lateral direction, and the second rotation center axis, in the plan view, is tilted in another direction with respect to the center line that extends in the longitudinal direction and passes through the center of the movable plate in the lateral direction, wherein the first rotation center axis is tilted at an angle with respect to the center line, the angle is more than 0 degree and is less than 90 degrees, and the first rotation center axis passes through the center line at the angle, the second rotation center axis is tilted at an angle with respect to the center line, the angle is more than 0 degree and is less than 90 degrees, and the second rotation center axis passes through the center line at the angle.

5. The mattress as claimed in claim 4, wherein the first rotation center axis is tilted at a tilting angle of 10 degrees or more and 15 degrees or less in the direction with respect to the center line in the plan view, and the second rotation center axis is tilted at a tilting angle of 10 degrees or more and 15 degrees or less in the another direction with respect to the center line in the plan view.

6. The mattress as claimed in claim 4, wherein the movable plate comprises a first plate member and a second plate member which is disposed below the first plate member and rotatably connected with the first plate member by the first rotation center axis.

7. The mattress as claimed in claim 6, further comprising a third plate member which is disposed below the second plate member and rotatably connected with the second plate member by the second rotation center axis different from the first rotation center axis, wherein the first plate member, the second plate member, and the third plate member are disposed to overlap each other in the plan view.

8. The mattress as claimed in claim 1, wherein the first mattress part is disposed on the center line that extends in the longitudinal direction of the mattress body and passes through a center of the mattress body in the lateral direction.

9. The mattress as claimed in claim 1, wherein a length of the first mattress part in the longitudinal direction is a half or less of a length of the mattress body, and in the longitudinal direction of the mattress body, and the first mattress part is disposed on a side on which a head part of a person is placed in the longitudinal direction of the mattress body.

10. The mattress as claimed in claim 1, wherein the first mattress part has a maximum length in the lateral direction that is two thirds of a length of the mattress body in the lateral direction of the mattress body.

11. The mattress as claimed in claim 1, wherein the first mattress part has a maximum length in the lateral direction that is 200 mm or more and 450 mm or less.

12. The mattress as claimed in claim 1, wherein a maximum tilting angle of the first mattress part is 20 degrees or more and 60 degrees or less with respect to a horizontal plane.

13. The mattress as claimed in claim 1, further comprising:

a pressure sensor for measuring a pressure in the first inflatable/contractible bag, wherein the control part is configured to perform control to stop the supplying of the gas to the first inflatable/contractible bag in a case where the pressure in the first inflatable/contractible bag measured by the pressure sensor exceeds a predetermined upper limit value and stop exhausting the gas from the first inflatable/contractible bag in a case where the pressure in the first inflatable/contractible bag measured by the pressure sensor drops below a predetermined lower limit value.

14. The mattress as claimed in claim 1, further comprising a second inflatable/contractible bag that is inflatable and contractible through supplying or exhausting of gas, wherein the second inflatable/contractible bag is disposed near the first mattress part on a side on which a foot of a person is placed in a longitudinal direction of the mattress body, and is configured to be provided below the second mattress part and supplied with the gas during rotation of the first mattress part.

* * * * *